US009909393B2

(12) United States Patent
Porter et al.

(10) Patent No.: US 9,909,393 B2
(45) Date of Patent: Mar. 6, 2018

(54) TUBING HANGER WITH SHUTTLE ROD VALVE

(71) Applicant: OneSubsea IP UK Limited, London (GB)

(72) Inventors: Dean Porter, Houston, TX (US); Benjamin Kobe, Houston, TX (US)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 15/109,952

(22) PCT Filed: Jan. 8, 2015

(86) PCT No.: PCT/IB2015/000464
§ 371 (c)(1),
(2) Date: Jul. 6, 2016

(87) PCT Pub. No.: WO2015/104646
PCT Pub. Date: Jul. 16, 2015

(65) Prior Publication Data

US 2016/0326838 A1 Nov. 10, 2016

Related U.S. Application Data

(60) Provisional application No. 61/925,106, filed on Jan. 8, 2014.

(51) Int. Cl.
*E21B 33/04* (2006.01)
*E21B 34/14* (2006.01)
*E21B 17/02* (2006.01)

(52) U.S. Cl.
CPC ..... *E21B 34/14* (2013.01); *E21B 17/02* (2013.01); *E21B 33/04* (2013.01)

(58) Field of Classification Search
CPC ..... E21B 34/14; E21B 17/02; E21B 33/04; E21B 34/02
See application file for complete search history.

(56) References Cited

U.S. PATENT DOCUMENTS 6,840,323 B2 * 1/2005 Fenton ..... B01D 17/0211 166/348
2010/0101800 A1 4/2010 June

FOREIGN PATENT DOCUMENTS

GB 2342668 A * 4/2000 ..... E21B 33/035
GB 2486770 A 6/2016

OTHER PUBLICATIONS

International Search Report issued in corresponding application No. PCT/IB2015/000464 dated Oct. 7, 2015; 3 pgs.

* cited by examiner

*Primary Examiner* — Giovanna C. Wright
*Assistant Examiner* — Brandon M Duck
(74) *Attorney, Agent, or Firm* — Chamberlain Hrdlicka

(57) ABSTRACT

A completion system for a well includes a tubing hanger movable into a landed position within an internal bore of the completion system. The tubing hanger includes a hanger bore formed through the tubing hanger, an auxiliary passage formed through the tubing hanger outside of the hanger bore, and a shuttle rod valve including a rod movable in a cavity that is capable of being in fluid communication with the auxiliary passage to control the flow of fluid through the auxiliary passage.

20 Claims, 8 Drawing Sheets

TUBING HANGER WITH SHUTTLE ROD VALVE

BACKGROUND

To meet the demand for natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a completion system that includes a wellhead assembly through which the resource is extracted. These completion systems may include a wide variety of components, such as various casings, hangers, valves, fluid conduits, and the like, that control drilling and/or extraction operations.

One type of completion assembly includes a wellhead with one or more strings of casing supported by casing hangers in the wellhead. Attached to the wellhead is a tubing spool. A tubing hanger secured to a string of tubing lands in the tubing spool above the wellhead or directly in the wellhead. The tubing hanger has a plurality of passages that provide access through the tubing hanger for hydraulic fluid or electrical lines to operate and control equipment located downhole, such as safety valves, temperature sensors, or chemical injection units, for instance.

A tree (sometimes referred to in the oil and gas industry as a christmas tree) may be installed on top of the tubing spool. The tree typically has a bore in fluid communication with the tubing string and tubing hanger and valves for controlling flow through the well. The passages in the tubing hanger connect with passages in the tree, which may provide access to a control unit in the tree.

BRIEF DESCRIPTION OF THE DRAWINGS

Various embodiments of the disclosed tubing hanger with shuttle rod valve will become better understood when the following detailed description is read with reference to the accompanying figures, in which like characters represent like parts throughout.

DETAILED DESCRIPTION OF SPECIFIC EMBODIMENTS

Figure 1:
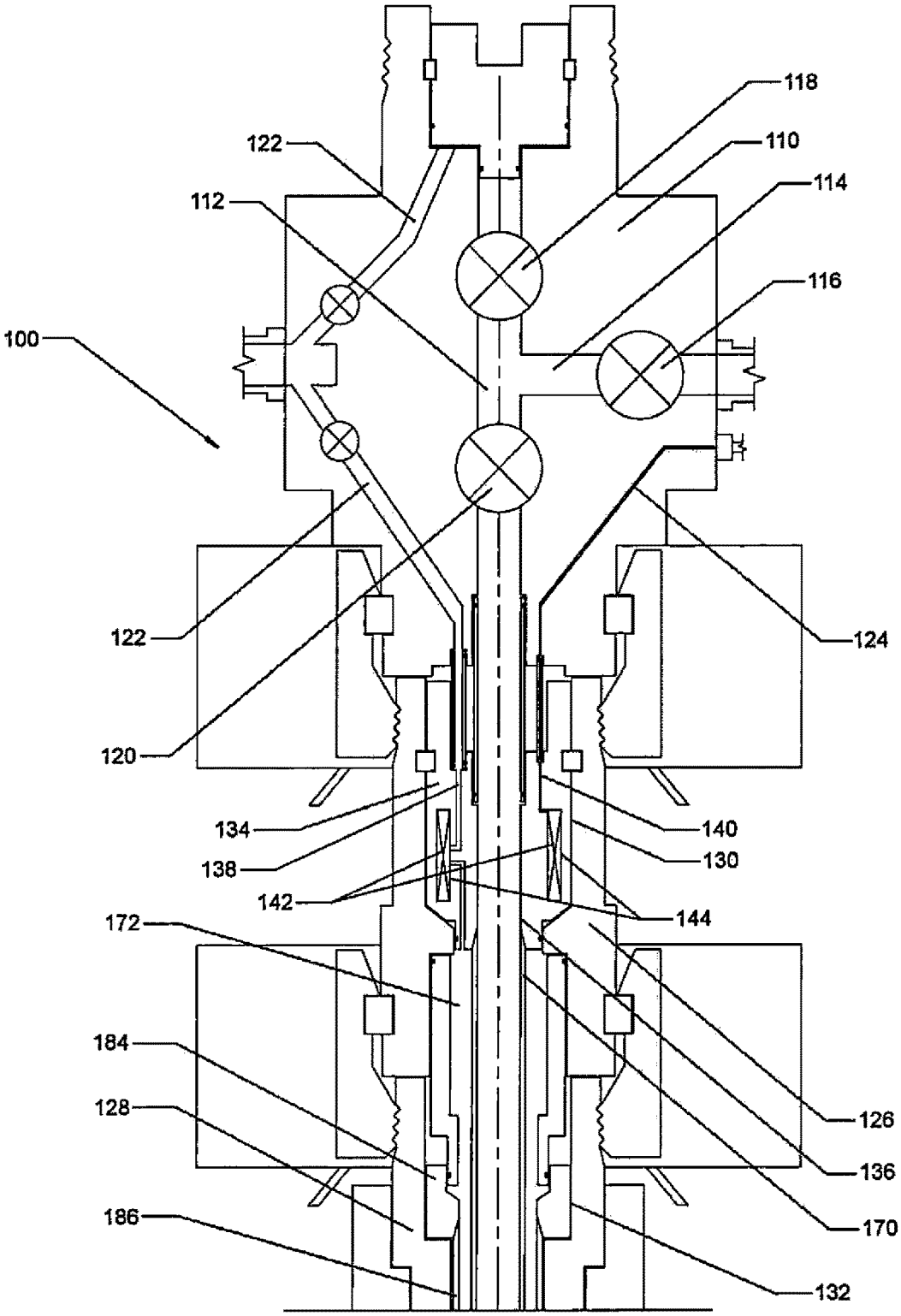
FIG. 1 shows a cross-sectional view of a completion system and assembly in accordance with one or more embodiments of the present disclosure.

The following discussion is directed to various embodiments of the present disclosure. The drawing figures are not necessarily to scale. Certain features of the embodiments may be shown exaggerated in scale or in somewhat schematic form and some details of conventional elements may not be shown in the interest of clarity and conciseness. The embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to imply that the scope of the disclosure, including the claims, is limited to that embodiment. Further, certain terms are used throughout the following description and claims to refer to particular features or components. As one skilled in the art will appreciate, different persons may refer to the same feature or component by different names. This document does not intend to distinguish between components or features that differ in name but are the same structure or function.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Accordingly, disclosed herein is a system and method for a well that may include and/or be used with a tree. The system and method may relate to use on the surface or subsea, such as with surface or subsea equipment or wells. Further, the system and method may include or relate to completion, production, and/or injection systems or methods, in addition to other types of systems and methods, whether or not included in the oil and gas industry. As such, though the system shown in FIG. 1 is a subsea system, the present disclosure is not so limited. Further, the system and method may include a vertical, horizontal, multi-bore, or mono-bore tree. The tree may be installable on other components of the completion system, such as installable on or within a wellhead and/or a tubing spool. The completion system may include a tubing hanger movable into a landed position within an internal bore of the completion system. The tubing hanger may include a hanger production bore formed through the tubing hanger, an auxiliary passage formed through the tubing hanger outside of the hanger production bore, and a shuttle rod valve movable within the tubing hanger to open and close, thereby controlling the flow of fluid through the auxiliary passage.

The present disclosure includes a shuttle rod valve that involves a cylindrical rod with radial seals that is moveable into an auxiliary passage (flow-bore) to seal and provide a seal barrier within and/or through the auxiliary passage. A cavity is formed within the tubing hanger, in which the cavity is in fluid communication with the auxiliary passage with the shuttle rod valve movable within the cavity, and the shuttle rod valve includes an axis that is arranged or positioned within the cavity itself. When in the closed position, the valve prevents flow of fluids through the auxiliary passage in either direction. When in the open position, the valve provides flow through the auxiliary passage and, in one or more embodiments, may expose a single radial seal to the fluids (e.g., liquids and/or gases) flowing through the auxiliary passage. This exposed (e.g., protector) seal may protect the barrier seal until the valve is moved to the closed position. Once in the closed position, the protector seal at the end (e.g., top, front) of the rod may enter into a relief in the seal bore, preventing the protector seal from contacting the seal bore and sealing. This allows the bi-directional barrier seal to be tested from above, such as through the auxiliary passage, prior to disconnecting the tree or tubing hanger running tool from the tubing hanger.

In one or more embodiments, the protector seal at the front of the rod may include or be replaced with a bi-directional seal. This would provide two barrier seals at the front of the rod when in the closed position. In this design, the relief in the seal bore may be eliminated so that both seals make a seal with the seal bore.

The valve would normally be moveable via pressure introduced into the cavity that the shuttle rod valve is positioned within, in which the pressure may act upon one or more piston surfaces that are formed or built into the rod itself and the body of the part in which the valve is assembled. For example, the shuttle rod valve may include a larger diameter portion and a smaller diameter portion to define one or more pistons within the shuttle rod valve, in which pressure may be exerted upon a piston surface to control movement of the shuttle rod valve. These piston surfaces and movement of the shuttle rod may be operated and moved by applying pressure (e.g., positive and/or negative pressure) through one or more valve control passages or control valve ports that communicate with the rod valve to act upon piston surfaces of the body of the shuttle rod valve. The control valve passages and/or ports may be fed from the tubing hanger body to the tree or tubing hanger running tool (THRT) through couplers, such as hydraulic couplers.

Referring now to FIG. 1, a cross-sectional view of a completion system 100 for a subsea well in accordance with one or more embodiments of the present disclosure are shown. The completion system 100 may include a production tree 110, such as a vertical subsea production tree as shown. The production tree 110 may include a main production bore 112 formed therethrough with a wing bore 114 intersecting with and extending from the main production bore 112. The wing bore 114 may include one or more valves in fluid communication therewith, such as a wing valve 116 that may be used to control the flow of fluid through the wing bore 114.

Further, the production tree 110 may include one or more valves in fluid communication therewith, such as a production swab valve 118 and/or a production master valve 120 in fluid communication with the main production bore 112 to control the flow of fluid through the main production bore 112. For example, the production swab valve 118 may be included within the main production bore 112 above the intersection of the main production bore 112 and the wing bore 114, and the production master valve 120 may be included within the main production bore 112 below the intersection of the main production bore 112 and the wing bore 114. The production tree 110 may include one or more auxiliary passages 122, such as an annulus flow path, that is formed within the production tree 110 and outside of the main production bore 112 (e.g., out of fluid communication with the main production bore 112). Further, in this embodiment, in addition to the auxiliary passage, the production tree 110 may include one or more valve control passages 124 formed therethrough and outside of the main production bore 112 and the auxiliary passage 122 within the production tree 110. For example, the valve control passage 124 may be used to control one or more valves within the completion system 100.

The production tree 110 may be connected to a tubing spool 126, such as installed or mounted on a top side of the tubing spool 126. Further, the tubing spool 126 may be connected to a wellhead 128 (e.g., high pressure housing), such as installed or mounted on a top side of the wellhead 128. The tubing spool 126 may include an internal bore 130 formed therethrough, such as extending from a top side of the tubing spool 126 down and through to a bottom side of the tubing spool 126. The wellhead 128 may also include an internal bore 132. In one or more embodiments, the tubing spool 126 may be removed or eliminated, in which the production tree 110 may be connected to the wellhead 128.

Further, as shown, a tubing hanger 134 may be moved into a landed position within the tubing spool 126, such as by having the tubing hanger 134 landed into the internal bore 130 of the tubing spool 126 below the production tree 110. In an embodiment in which no tubing spool 126 may be present, the tubing hanger 134 may be landed into the internal bore 132 of the wellhead 128. The tubing hanger 134 may include a production bore 136 formed therethrough, one or more auxiliary passages 138 formed therethrough, and/or one or more valve control passages 140 formed therein. For example, the tubing hanger 134 may include the auxiliary passage 138 formed therethrough, such as extending from a top side of the tubing hanger 134 to a bottom side of the tubing hanger 134, which is outside of the production bore 136 (e.g., out of fluid communication with the production bore 136). The tubing hanger 134 may also include the valve control passage 140 formed therein that is outside of the production bore 136 and the auxiliary passage 138.

Referring still to FIG. 1, the tubing hanger 134 may include one or more valves, such as a valve 142, included therein to control the flow of fluid therethrough. For example, the valve 142 may be in fluid communication with the auxiliary passage 138, thereby enabling the valve 142 to control the flow of fluid through the auxiliary passage 138. As shown, the tubing hanger 134 may include a cavity 144 formed therein, in which the valve 142 may be movably positioned within the cavity 144, such as by having the valve 142 movable between an open position and a closed position within the cavity 144. For example, the valve 142 may be in the open position to allow fluid to flow through the auxiliary passage 138, and the valve 142 may be in the closed position to prevent fluid to flow through the auxiliary passage 138. Further, as the valve 142 may be positioned and movable within the cavity 144, the one or more valve control passages 140 formed within the tubing hanger 134 may be in fluid communication with the valve 142 and the cavity 144 to control the valve 142.

The tubing hanger 134 may be used to support production tubing 170 therefrom. For example, an upper end of the production tubing 170 may be supported within the production bore 136 of the tubing hanger 134, thereby forming an annulus 172 outside of the production tubing 170. The production tubing 170 supported from the tubing hanger 134 may extend, at least partially, into the central bore 132 of the wellhead 128.

Further, in one or more embodiments, a casing hanger may be included within the completion system 100, such as by having a casing hanger 184 moved into a landed position within the central bore 132 of the wellhead 128 below the tubing spool 126. As such, production casing 186 may be supported from the casing hanger 184 and extend into the central bore 132 of the wellhead 128. As shown, in such an embodiment, the production casing 186 may surround the production tubing 170, thereby having the annulus 172 defined as the annular area between the production tubing 170 and the production casing 186. As such, in one or more embodiments, the annulus 172 may be formed between the exterior of the production tubing 170 and the interior of the production casing 186 and/or the central bore 132 of the wellhead 128. Accordingly, the auxiliary passage 138 of the tubing hanger 134 may be in fluid communication with the annulus 172, thereby enabling fluid to selectively flow into and/or out-of the annulus 172 through the auxiliary passage 138 of the tubing hanger 134.

When the production tree 110 is installed on the tubing spool 126, as shown in FIG. 1, the main production bore 112 of the production tree 110 may be in fluid communication with the production bore 136 of the tubing hanger 134. Further, in such an embodiment, the auxiliary passage of the production tree 110, such as the upper auxiliary passage 122 may be in fluid communication with the auxiliary passage 138 of the tubing hanger 134. The valve control passages of the production tree 110, such as the valve control passage 124, may be in fluid communication with valve control passages of the tubing hanger 134, such as the valve control passage 140. Further, the valve control passage 124 may not be necessary within the production tree 110, in which the valve control passage(s) 140 of the tubing hanger 134 may extend through and exterior to the tubing spool 126 (when present) and/or the wellhead 128.

Figure 2A:
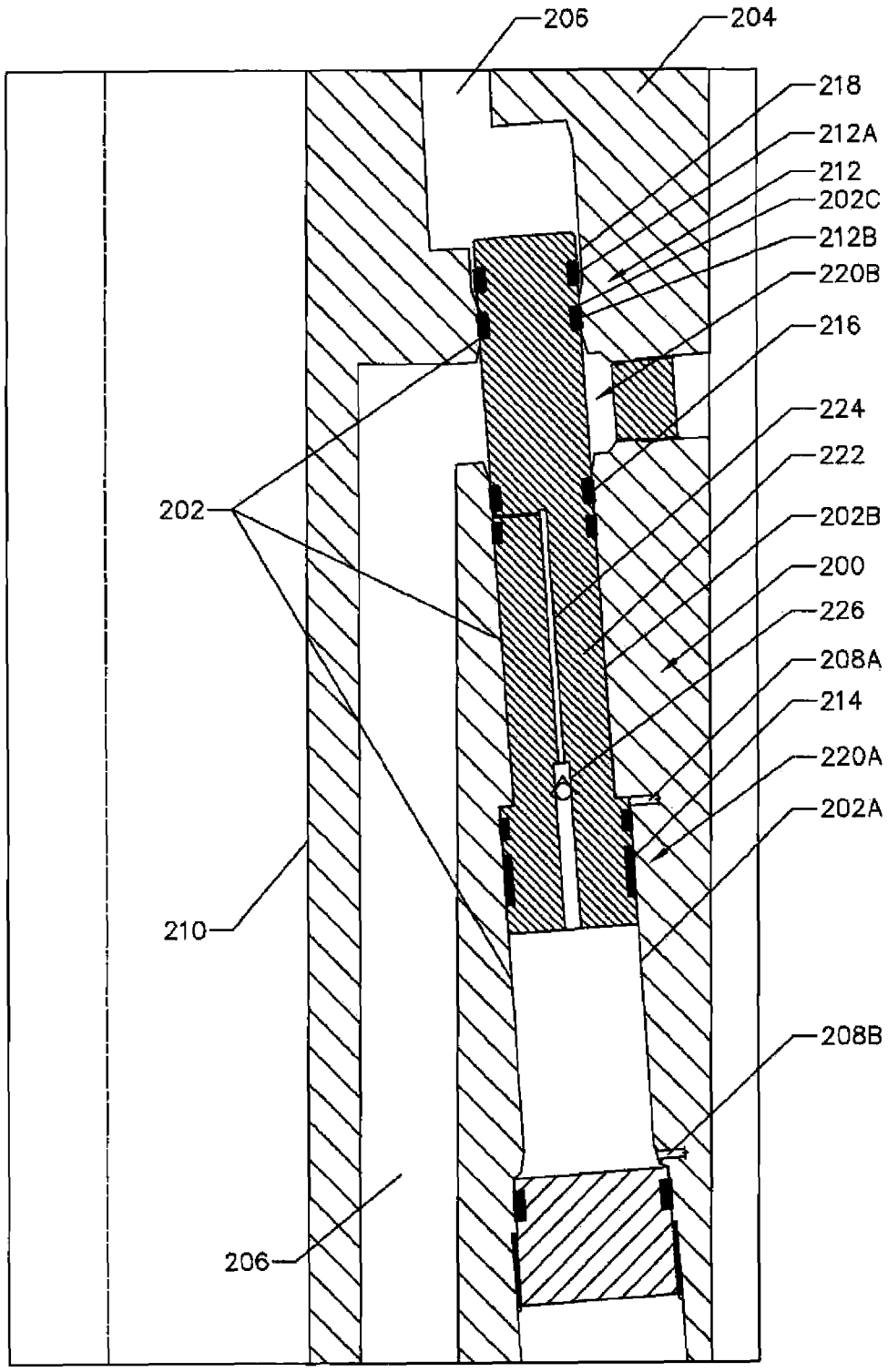
FIGS. 2A and 2B show multiple cross-sectional views of a valve in accordance with one or more embodiments of the present disclosure.
Figure 2B:
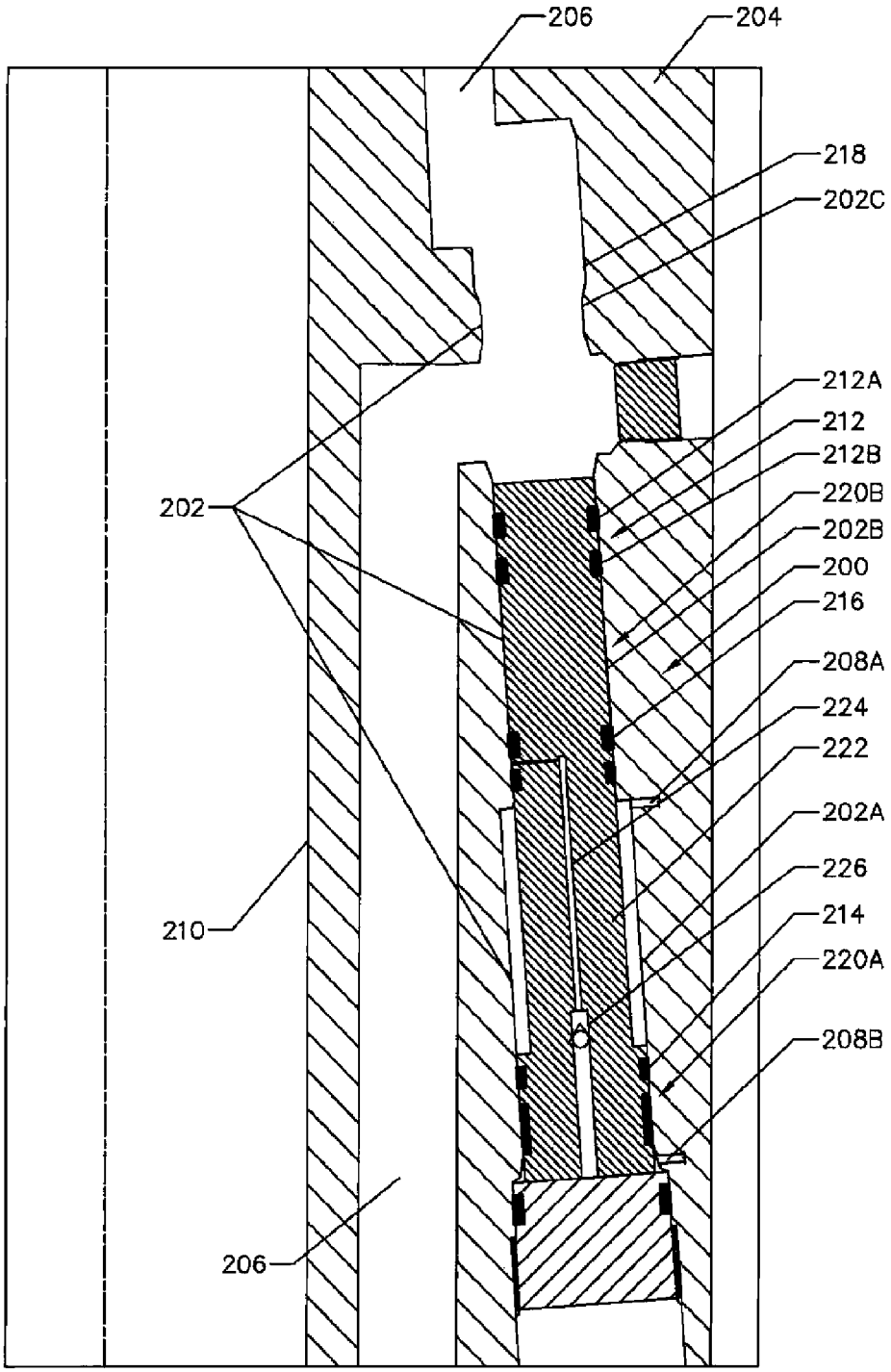

Referring now to FIGS. 2A and 2B, multiple cross-sectional views of a valve 200, such as a shuttle rod valve, in accordance with one or more embodiments of the present disclosure are shown. FIG. 2A shows the shuttle rod valve 200 positioned within a cavity 202 including one or more bores 202A, 202B, and 202C of a tubing hanger 204, in which the bore 202C of the cavity 202 is in fluid communication with an auxiliary passage 206 formed through the tubing hanger 204. FIG. 2A shows the shuttle rod valve 200 in the closed position, thereby preventing fluid flow through the auxiliary passage 206 of the tubing hanger 204. FIG. 2B shows the shuttle rod valve 200 in an open position, thereby enabling fluid flow through the auxiliary passage 206 of the tubing hanger 204. In this embodiment, as the valve 200 may be a shuttle rod valve, the shuttle rod valve 200 may include or be formed about an axis, in which the axis may be arranged or oriented within the cavity 202 of the tubing hanger 204.

The movement of the valve 200 may be controlled using one or more valve control passages 208A and 208B, which may define opening and closing volumes within the cavity 202, to provide pressure to control movement of the shuttle rod valve 200. As such, the valve control passages 208A and 208B may be formed within the tubing hanger 204 outside of a hanger production bore 210 and the auxiliary passage 206. In one embodiment, pressure may be provided through an opening control passage 208A to move the valve 200 towards the open position, and pressure may be provided through a closing control passage 208B to move the valve 200 towards the closed position.

The shuttle rod valve 200 may include one or more seals to seal between the shuttle rod valve 200 and the cavity 202 of the tubing hanger 204. For example, as shown, the shuttle rod valve 200 may include one or more first end seals 212 (e.g., first set of seals) positioned adjacent one end of the shuttle rod valve 200, one or more second end seals 214 (e.g., second set of seals) positioned adjacent another end of the shuttle rod valve 200, and one or more mid seals 216 (e.g., third set of seals) positioned on the shuttle rod valve 200 between the first end seal 212 and the second end seal 214. In one embodiment, the first end seals 212 (e.g., first set of seals) may include a protector seal 212A and a barrier seal 212B.

When in the closed position, the valve 200 may prevent flow of fluids through the auxiliary passage 206 in either direction. When in the open position, the valve 200 provides flow through the auxiliary passage 206 and, in one or more embodiments, may expose one or more seals to the fluids (e.g., liquids and/or gases) flowing through the auxiliary passage 206. As shown in FIG. 2B, the protector seal 212A may be exposed to protect the barrier seal 212B until the valve 200 is moved to the closed position. Once in the closed position, the protector seal 212A at the end (e.g., top, front) of the valve 200 may enter into a relief 218 in the cavity 202, preventing the protector seal 212A from contacting the cavity 202 and sealing. This may allow the bi-directional barrier seal 212B to be tested from above, such as through the auxiliary passage 206, prior to disconnecting the tree or tubing hanger running tool from the tubing hanger. In another embodiment, the protector seal 212A may include or be replaced with a bi-directional seal. This would provide two barrier seals at the front of the valve 200 when in the closed position. In this embodiment, the relief 218 may be eliminated so that both seals make a seal with the cavity 202.

The valve 200 may be moveable via pressure introduced into the cavity 202 that the shuttle rod valve 200 is positioned within, in which the pressure may act upon one or more piston surfaces that are formed or built into the shuttle rod valve 200. For example, the shuttle rod valve 200 may include a larger diameter portion 220A and a smaller diameter portion 220B to define one or more pistons 222 within the shuttle rod valve 200. Pressure may be exerted upon a surface of the piston 222 to control movement of the shuttle rod valve 200. These piston surfaces and movement of the shuttle rod valve 200 may be operated and moved by applying pressure (e.g., positive and/or negative pressure) through one or more valve control passages 208A and 208B that communicate with the shuttle rod valve 200. The valve control passages 208A and 208B and/or ports may be fed from the tubing hanger 204 to (i.e., in fluid communication with) a production tree or tubing hanger running tool (THRT) through couplers, such as hydraulic couplers.

Referring still to FIGS. 2A and 2B, the shuttle rod valve 200 may include a vent passage 224 with a check valve 226 that allows one-way communication from behind (e.g., beneath) a mid seal 216 to the close function volume within the cavity 202. The check valve 226 and vent passage 224 may prevent the valve 200 from opening in the case of pressure leaking from the auxiliary passage 206 past the mid seal 216 and into the open function volume to move the shuttle rod valve 200 towards the open position. As such, the shuttle rod valve 200 may include the vent passage 224 formed through the shuttle rod valve 200 with the check valve 226 positioned within the vent passage 224, the check valve 226 preventing pressure from passing from the larger diameter portion 220A to the smaller diameter portion 220B of the shuttle rod valve 200.

Figure 3A:
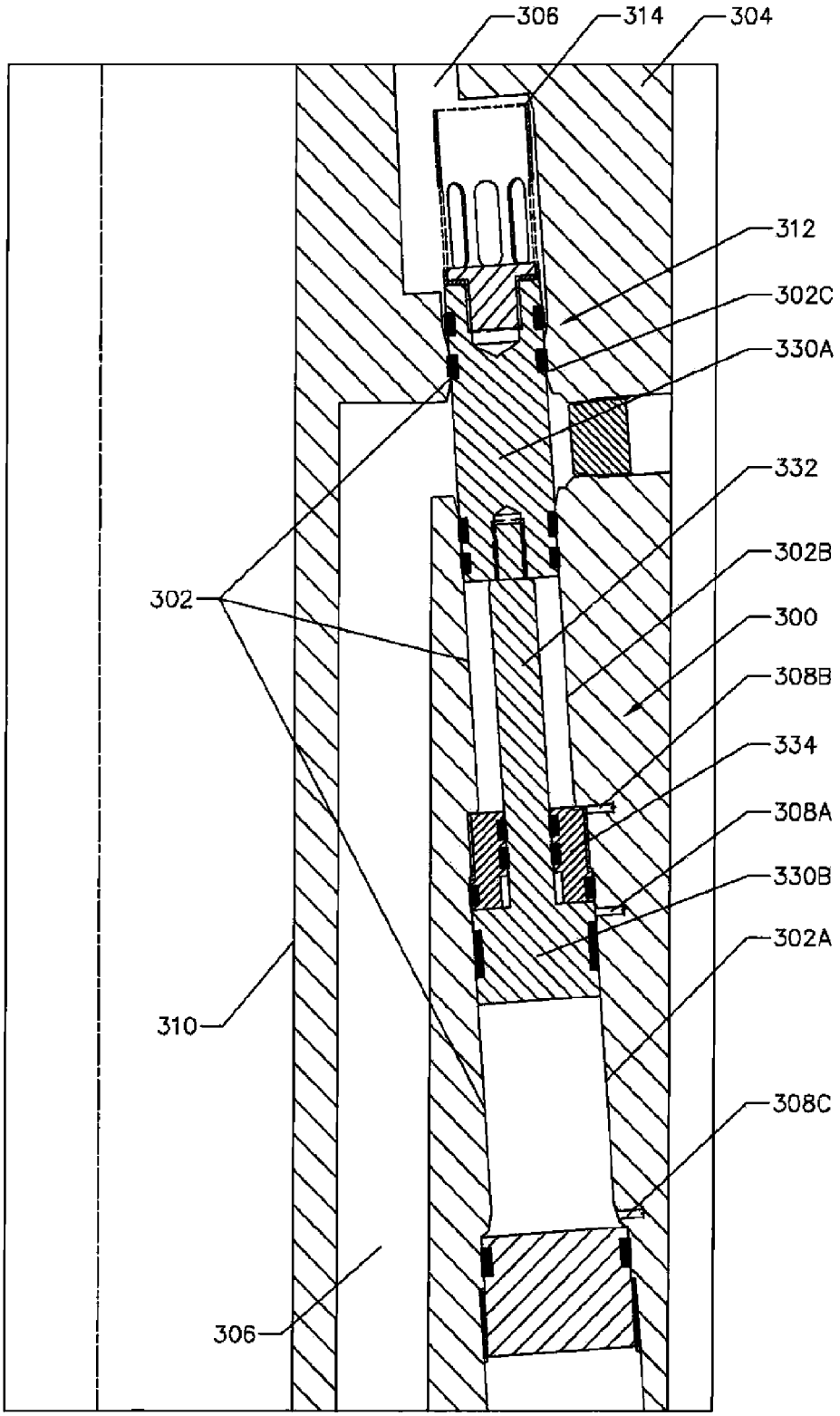
FIGS. 3A and 3B show multiple cross-sectional views of a valve in accordance with one or more embodiments of the present disclosure.
Figure 3B:
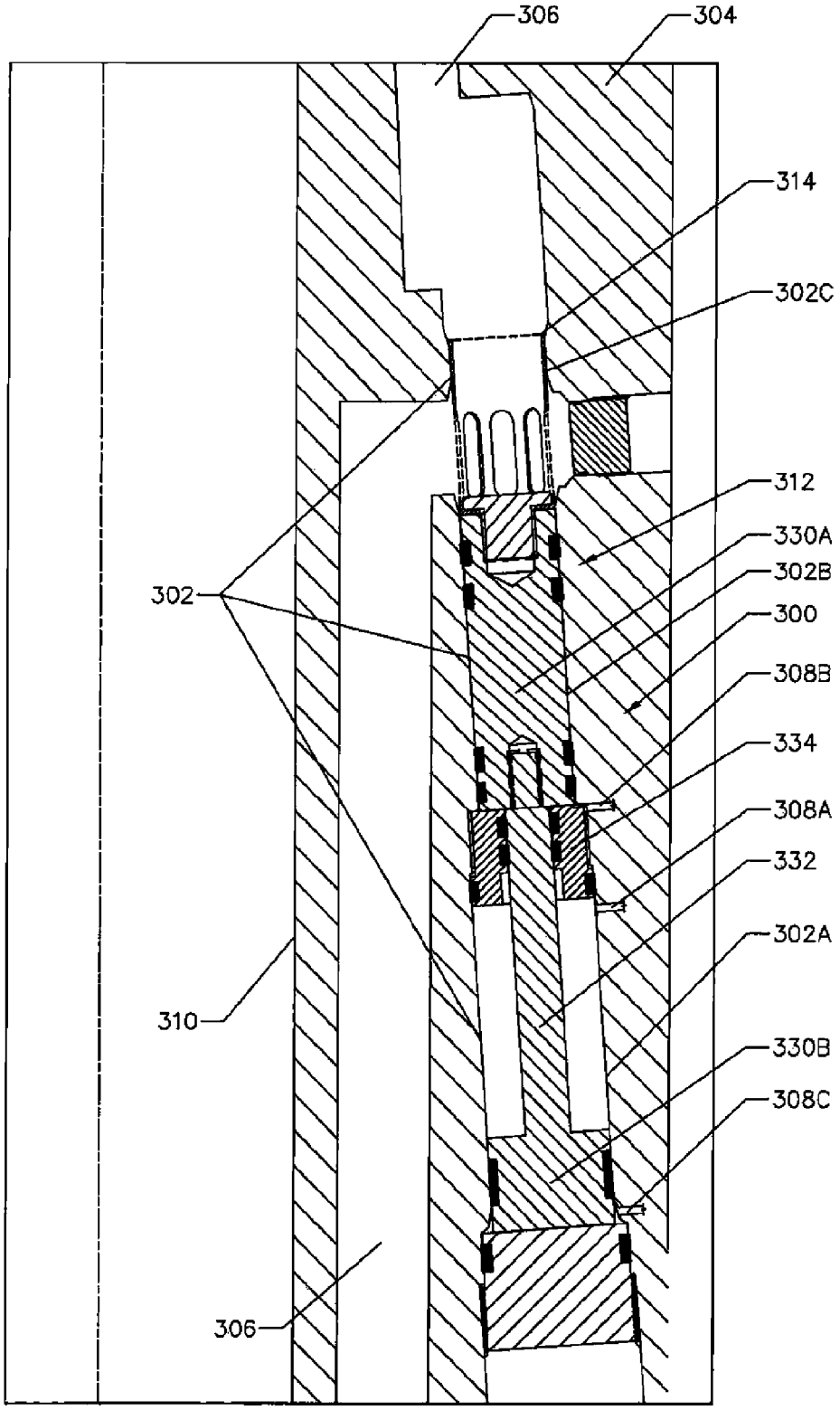

Referring now to FIGS. 3A and 3B, multiple cross-sectional views of a valve 300, such as a shuttle rod valve, in accordance with one or more embodiments of the present disclosure are shown. FIG. 3A shows the shuttle rod valve 300 positioned within a cavity 302 that includes one or more bores 302A, 302B, and 302C of a tubing hanger 304, in which the bore 302C of the cavity 302 is in fluid communication with an auxiliary passage 306 formed through the tubing hanger 304. FIG. 3A shows the shuttle rod valve 300 in the closed position, thereby preventing fluid flow through the auxiliary passage 306 of the tubing hanger 304. FIG. 3B shows the shuttle rod valve 300 in an open position, thereby enabling fluid flow through the auxiliary passage 306 of the tubing hanger 304.

In this embodiment, the movement of the valve 300 may be controlled using one or more valve control passages 308A, 308B, and 308C, which may define opening and closing volumes within the cavity 302. For example, in this embodiment, pressure may be provided through an opening control passage 308A to move the valve 300 towards the open position, and pressure may be provided through one or both closing control passages 308B and 308C to move the valve 300 towards the closed position. This embodiment may allow for redundancy of the close function.

Further, in this embodiment, the shuttle rod valve 300 may include a first body 330A and a second body 330B with a stem 332 extending between the first body 330A and the second body 330B. A separation block 334 may then be fixed within the cavity 302 between the first body 330A and the second body 330B. The stem 332 may be slidably received through the separation block 334 such that the first body 330A and the second body 330B move in unison with respect to the separation block 334. Further, the valve control passage 308A may formed within the tubing hanger 304 on one side of the separation block 334 that is outside of the hanger production bore 310 and the auxiliary passage 306 to provide pressure to open the shuttle rod valve 300. A valve control passage 308B and 308C may be formed within the tubing hanger 304 on another side of the separation block 334 that is outside of the hanger production bore 310 and the auxiliary passage 306 to provide pressure to close the shuttle rod valve 300.

In one or more embodiments, the valve 300, in addition or in alternative to the other embodiments of the system and the shuttle rod valve discussed herein, may include an additional or alternative method of opening. For example, pressure may be applied through the auxiliary passage 306, such as from above, that exerts pressure upon the top of the shuttle rod valve 300 to move and push the shuttle rod valve 300 away from the closed position and towards the open position. As such, in one or more embodiments, the shuttle rod valve 300 (and/or the shuttle rod valve 200 and 400) may be opened with pressure applied through the auxiliary passage. Further, pressure may be applied to the open function (e.g., through the valve control passage 308A), the close functions may have pressure bled or relieved (e.g., through the valve control passages 308B and 308C), with the pressure from above continuing to be exerted upon the top of the shuttle rod valve 300. In such an embodiment, even if the open function controlled by control passage 308A is leaking, the pressure from above may allow the valve 300 to open, at least partially. Further, in one or more embodiments, to protect the seal surfaces for the upper barrier seals 312, a protective sleeve 314 could be used to cover the seal surface when the valve is in the open position, but still enabling fluid flow through the auxiliary passage 306 of the tubing hanger 304.

Figure 4A:
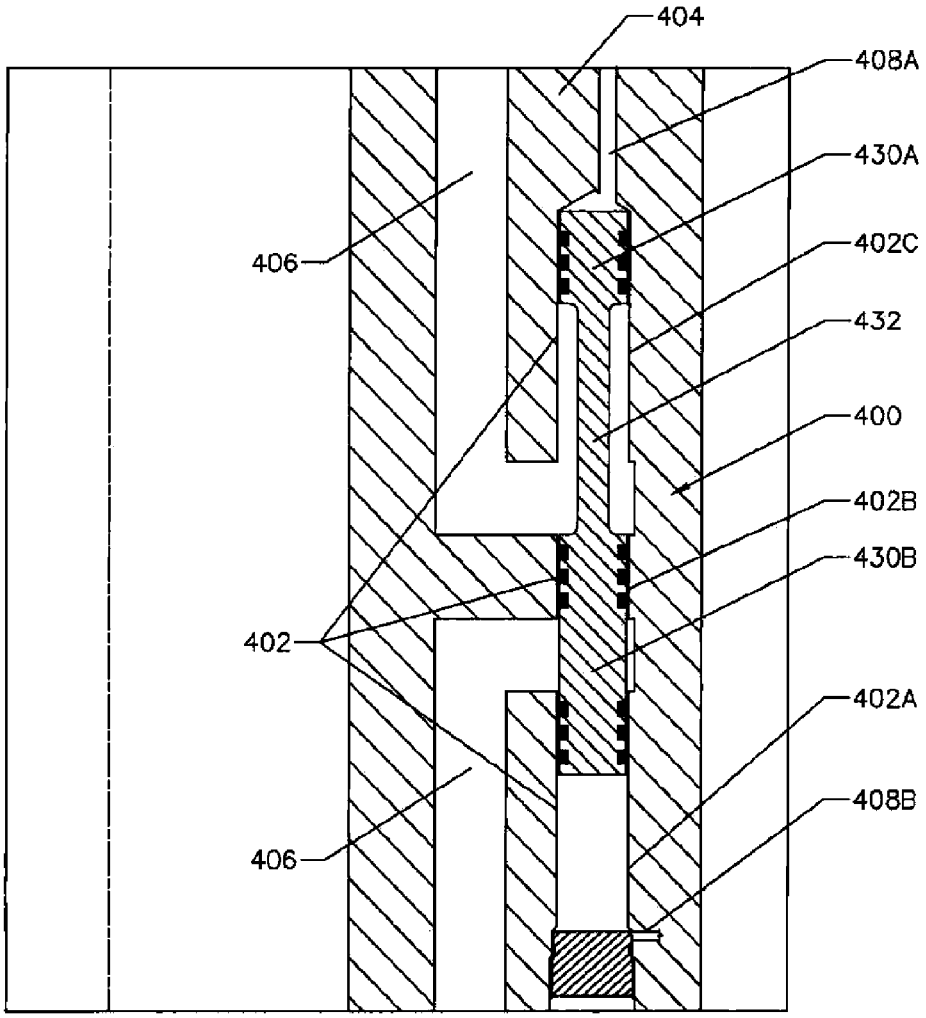
FIGS. 4A and 4B show multiple cross-sectional views of a valve in accordance with one or more embodiments of the present disclosure.
Figure 4B:
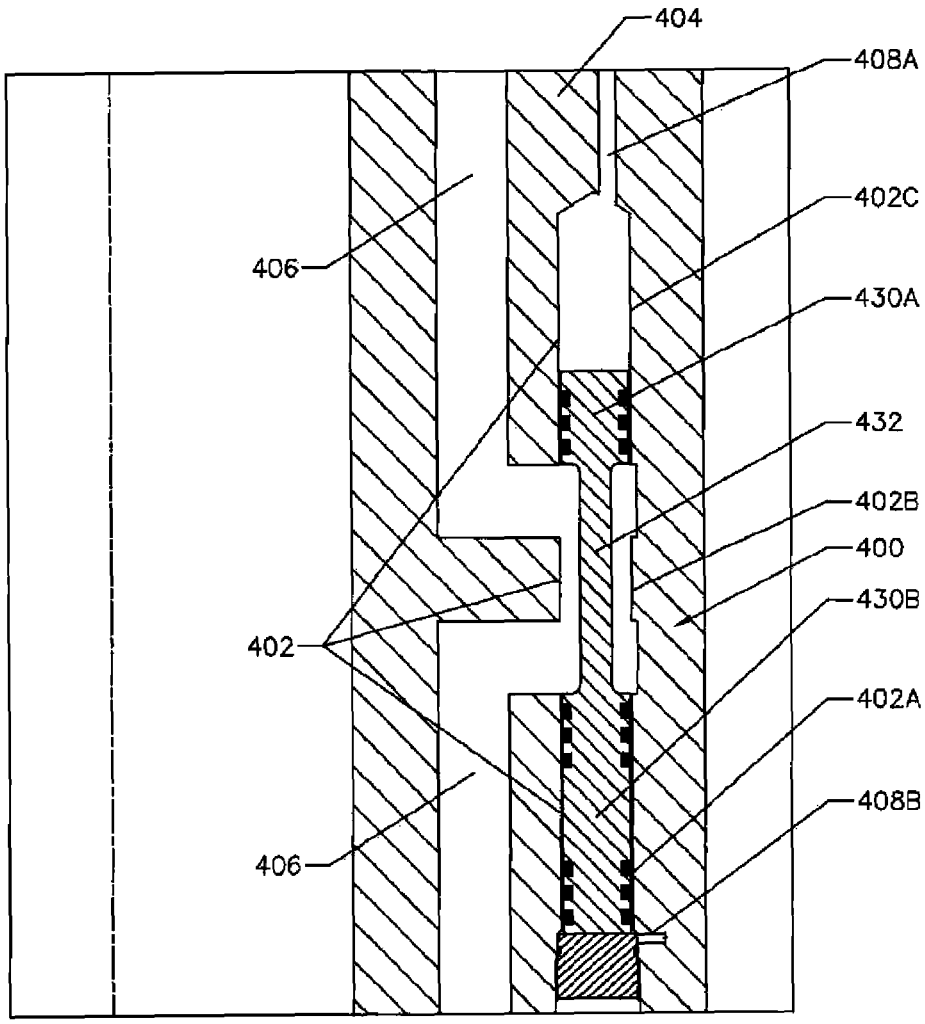

Referring now to FIGS. 4A and 4B, multiple cross-sectional views of a valve 400, such as a shuttle rod valve, in accordance with one or more embodiments of the present disclosure are shown. FIG. 4A shows the shuttle rod valve 400 positioned within a cavity 402 including one or more bores 402A, 402B, and 402C of a tubing hanger 404, in which the bore 402B is in fluid communication with an auxiliary passage 406 formed through the tubing hanger 404. FIG. 4A shows the shuttle rod valve 400 in the closed position, thereby preventing fluid flow through the auxiliary passage 406 of the tubing hanger 404. FIG. 4B shows the shuttle rod valve 400 in an open position, thereby enabling fluid flow through the auxiliary passage 406 of the tubing hanger 404.

In this embodiment, the movement of the valve 400 may be controlled using one or more valve control passages 408A and 408B, which may define opening and closing volumes within the cavity 402. For example, in this embodiment, pressure may be provided through an opening control passage 408A to move the valve 400 towards the open position, and pressure may be provided through a closing control passage 408B to move the valve 400 towards the closed position. Further, in this embodiment, the shuttle rod valve 400 may include a first body 430A and a second body 430B with a stem 432 extending between the first body 430A and the second body 430B. In the open position, the stem 432 of the valve 400 may be positioned within the cavity 402 between the portions of the auxiliary passage 406 to enable flow around the stem 432 and through the auxiliary passage 406. In the closed position, the second body 430B (e.g., lower body) may be positioned within the cavity 402 between the portions of the auxiliary passage 406 to prevent flow through the auxiliary passage 406.

Further, as with the other embodiments, the valve 400 may include (at least) three (sets of) radial seals that shuttle to open and close the valve 400. Further, in this embodiment, the valve 400 may be pressure balanced in the open and closed positions and may not be affected by pressure in the auxiliary passage 400, such as pressure in the annulus from above or below that is in fluid communication with the auxiliary passage 400.

Figure 5:
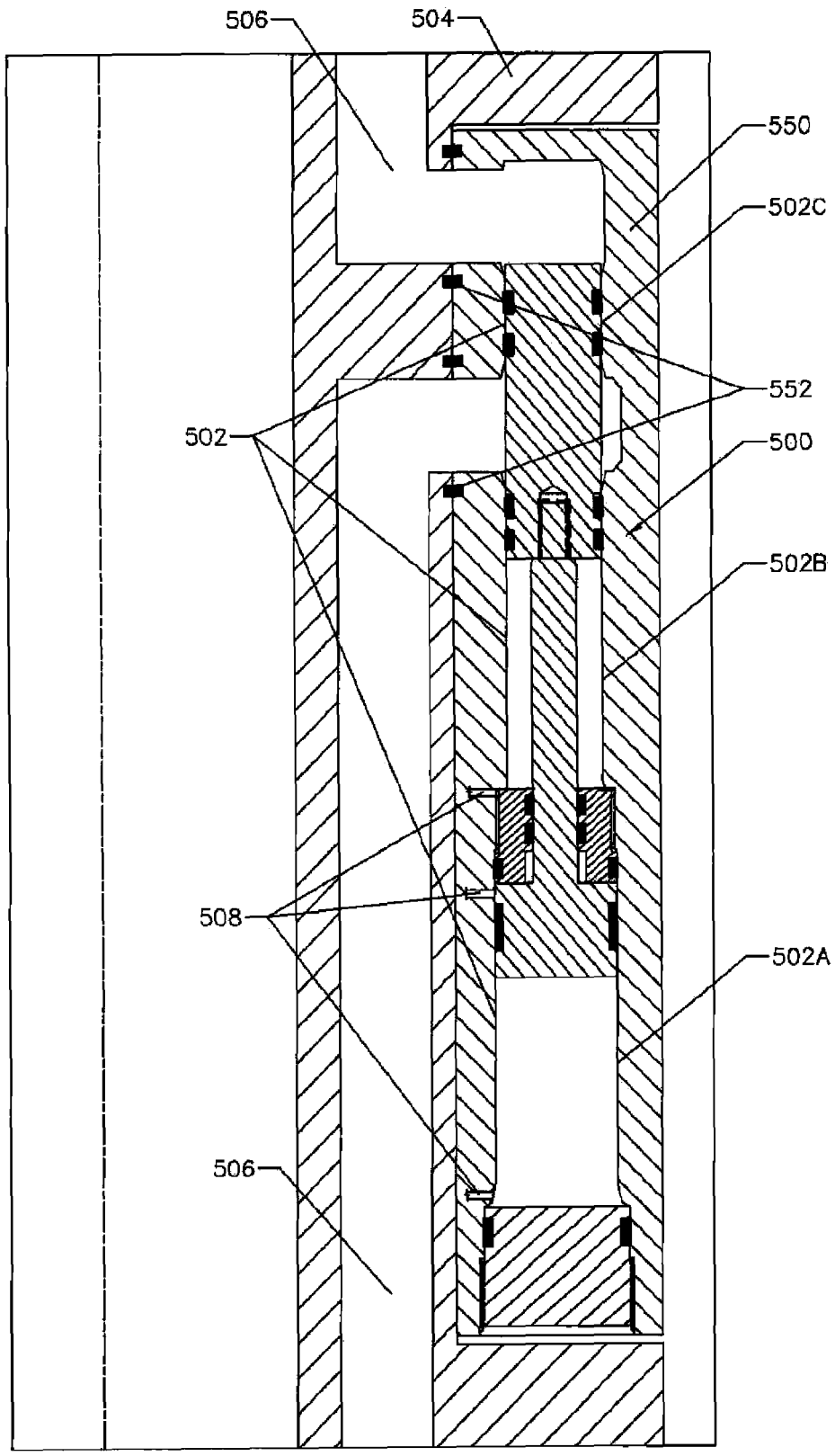
FIG. 5 shows a cross-sectional view of a valve in accordance with one or more embodiments of the present disclosure.

In one or more embodiments, a valve in accordance with the present disclosure may be removably attachable to the body or component with the auxiliary passages being controlled. For example, with reference to FIG. 5, a valve 500, such as a shuttle rod valve similar to the embodiment shown in FIGS. 3A and 3B, may be included or housed within a separate valve unit, body, block, or section 550, in which the valve section 550 may then be removably and sealingly connected and/or attachable to the tubing hanger 504. This may enable the auxiliary passage 506 of the tubing hanger 504 to be in fluid communication with and pass through the valve section 550. One or more seals and/or gaskets 552 may be able to sealingly engage the auxiliary passage 506 with the valve section 550. Further, in this embodiment, the movement of the valve 500 may be controlled using one or more valve control passages 508, which may define opening and closing volumes within the cavity 502, which includes one or more bores 502A, 502B, and 502C of a valve section 550.

As discussed above, in one or more embodiments, a valve in accordance with the present disclosure may be used to selectively open or close an annulus bore that is in fluid communication with the auxiliary passage of the tubing hanger, in which the tubing hanger may be installed into a wellhead. Further, one having ordinary skill in the art will appreciate that, though it is described that increased pressure may be provided to the opening side or the closing side of the cavity to move the valve between the open position and the closed position within the cavity, those having ordinary skill in the art will appreciate that other mechanisms and/or other configurations may be used without departing from the scope of the present disclosure to move the valve between the open position and the closed position. For example, in one embodiment, decreased pressure, such as a vacuum, may be used to move the valve between the open position and the closed position. Alternatively, the valve may be moveable axially, such as by using a mechanical actuation device, which may include a drive screw, a puller arm, and/or any other type of mechanical actuation device known in the art.

Some tree system designs require the annulus bore to flow through the tubing hanger assembly. Due to space limitations, it may be difficult to design a valve that provides adequate flow area for the annulus and also allows room in the tubing hanger assembly for other features such as hydraulic and electrical feedthroughs. In some embodiments, the tubing hanger with shuttle rod valve of the present disclosure may include production tubing supported within the hanger production bore of the tubing hanger such that an annulus is formed outside the production tubing and the auxiliary passage of the tubing hanger is in fluid communication with the annulus.

For some tubing hangers, operators plan to flow gas through the annulus (and therefore the auxiliary passage of the tubing hanger as well) for the purpose of gas lifting the production fluids. This gas flow has the potential to damage elastomer seals through explosive decompression or aging. A valve in accordance with the present disclosure may keep all but one of the seals away from the flow of gas so that the seals are protected, such as during the gas lift operation.

The present disclosure is currently planned for use in a tubing hanger, though the present disclosure also contemplates other uses outside of a tubing hanger and outside of the oilfield industry altogether. The valve may be used to provide an annulus barrier to the environment prior to disconnecting the tree or tubing hanger running tool from the tubing hanger. The present disclosure could be used in any tubing hanger design, but may specifically be used within vertical tree tubing hangers, and more particularly within a vertical monobore tree (VMXT) with a tubing hanger located in the wellhead. Accordingly, a wellhead may include an internal bore, in which the tubing hanger may be movable into a landed position within the internal bore of the wellhead. Further, a tubing hanger in accordance with the present disclosure may be used as a production tubing hanger, a casing tubing hanger, and/or any other type of hanger to support one or more tubular members therefrom without departing from the scope of the present disclosure.

While the disclosure may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A completion system for a well, comprising:

a tubing hanger movable into a landed position within an internal bore of the completion system, the tubing hanger including:

a hanger bore formed through the tubing hanger;

an auxiliary passage formed through the tubing hanger outside of the hanger bore; and a shuttle rod valve comprising:

a rod axially movable in a cavity that is capable of being in fluid communication with the auxiliary passage to control the flow of fluid through the auxiliary passage; and a vent passage formed within the shuttle rod valve with a check valve positioned within the vent passage of the shuttle rod valve.

2. The system of claim 1, further comprising production tubing supported by the tubing hanger such that an annulus is formed outside of the production tubing and such that the auxiliary passage of the tubing hanger is in fluid communication with the annulus.

3. The system of claim 1, further comprising a valve control passage formed within the tubing hanger outside of the hanger bore and the auxiliary passage to provide pressure to control movement of the shuttle rod valve.

4. The system of claim 1, further comprising a mechanical actuation device to control movement of the shuttle rod valve.

5. The system of claim 1, wherein the cavity is formed within the tubing hanger, wherein the cavity is in fluid communication with the auxiliary passage with the shuttle rod valve movable within the cavity, and wherein the shuttle rod valve comprises an axis that is arranged within the cavity.

6. The system of claim 5, wherein the shuttle rod valve comprises a first body and a second body with a stem extending between the first body and the second body, and a separation block fixed within the cavity, wherein the stem is slidably received through the separation block such that the first body and the second body move in unison with respect to the separation block.

7. The system of claim 6, further comprising:

an opening valve control passage port formed within the tubing hanger on one side of the separation block that is outside of the hanger bore and the auxiliary passage to provide pressure to open the shuttle rod valve; and a closing valve control passage port formed within the tubing hanger on another side of the separation block that is outside of the hanger bore and the auxiliary passage to provide pressure to close the shuttle rod valve.

8. The system of claim 1, wherein the shuttle rod valve comprises a larger diameter portion and a smaller diameter portion to define a piston within the shuttle rod valve, wherein pressure is exerted upon the piston to control movement of the shuttle rod valve.

9. The system of claim 8, wherein the check valve is configured to allow pressure to pass from the smaller diameter portion to the larger diameter portion and to prevent pressure from passing from the larger diameter portion to the smaller diameter portion of the shuttle rod valve.

10. The system of claim 1, wherein the shuttle rod valve comprises a first end seal positioned adjacent one end of the shuttle rod valve, a second end seal positioned adjacent another end of the shuttle rod valve, and a mid seal positioned on the shuttle rod valve between the first end seal and the second end seal.

11. The system of claim 10, wherein the first end seal comprises a protector seal and a barrier seal, wherein the protector seal is configured to disengage the cavity when the shuttle rod valve is closed, thereby exposing the barrier seal to pressure from the auxiliary passage, and wherein the protector seal is configured to engage the cavity when the shuttle rod is open, thereby preventing the barrier seal from exposure to pressure from the auxiliary passage.

12. The system of claim 1, wherein the shuttle rod valve is configured to open from pressure applied through the auxiliary passage.

13. The system of claim 1, further comprising a wellhead including an internal bore capable of fluid communication with the internal bore of the completion system, wherein the tubing hanger is movable into a landed position within the internal bore of the wellhead.

14. The system of claim 1, wherein the shuttle rod valve is housed within a body that is removably and sealingly connected to the tubing hanger with the auxiliary passage in fluid communication with the body.

15. A method of controlling fluid flow through an auxiliary passage of a tubing hanger, the method comprising:

landing the tubing hanger with tubing supported by the tubing hanger within an internal bore of a completion system, thereby forming an annulus between the tubing and the internal bore of the completion system;

selectively controlling fluid flow through the auxiliary passage of the tubing hanger in fluid communication with the annulus using a shuttle rod valve comprising a rod axially movable in a cavity that is in fluid communication with the auxiliary passage and a vent passage formed within the shuttle rod valve with a check valve positioned within the vent passage of the shuttle rod valve, the auxiliary passage formed through the tubing hanger and outside of a hanger bore formed through the tubing hanger.

16. The method of claim 15, wherein the selectively controlling fluid flow comprises at least one of:

opening the shuttle rod valve to enable fluid flow through the auxiliary passage of the tubing hanger; and closing the shuttle rod valve to prevent fluid flow through the auxiliary passage of the tubing hanger.

17. The method of claim 15, wherein the tubing hanger comprises the cavity in fluid communication with the auxiliary passage, and wherein the selectively controlling fluid flow comprises:

moving the shuttle rod valve within the cavity with an axis of the shuttle rod valve arranged within the cavity.

18. The method of claim 17, wherein the shuttle rod valve comprises a larger diameter portion and a smaller diameter portion to define a piston within the shuttle rod valve, wherein moving the shuttle rod valve comprises:

exerting pressure upon the piston, thereby controlling movement of the shuttle rod valve.

19. The method of claim 18, further comprising:

releasing pressure from the smaller diameter portion to the larger diameter portion of the shuttle rod valve through the check valve.

20. An apparatus for controlling fluid flow, comprising:

a tubing hanger comprising a main passage and an auxiliary passage formed therethrough; and a shuttle rod valve in fluid communication with the auxiliary passage and movable in a cavity of the tubing hanger to open and close to control the flow of fluid through the auxiliary passage, the shuttle rod comprising:

a first body;

a second body;

a stem extending between the first body and the second body;

a separation block fixed within the cavity; and wherein the stem is slidably received through the separation block such that the first body and the second body move in unison with respect to the separation block.

* * * * *